US005875951A

United States Patent [19]

Ingle et al.

[11] Patent Number: 5,875,951

[45] Date of Patent: Mar. 2, 1999

[54] DRIVE RING DRIVER

[76] Inventors: Carroll G. Ingle, 19045 Talquin Dr., Tallahassee, Fla. 32310; Russell C. Tennent, P.O. Box 2302, Tallahassee, Fla. 32316

[21] Appl. No.: 942,418

[22] Filed: Sep. 29, 1997

[51] Int. Cl.[6] ..... B25C 1/02

[52] U.S. Cl. ..... 227/147; 173/90

[58] Field of Search ..... 173/90, 91; 227/147, 227/142, 10, 146

[56] References Cited

U.S. PATENT DOCUMENTS

| | | | |
|---|---|---|---|
| 2,767,399 | 10/1956 | Widener | 227/146 |
| 3,117,378 | 1/1964 | Bowen | 227/147 |
| 4,438,769 | 3/1984 | Pratt et al. | 227/147 |
| 4,562,948 | 1/1986 | Floyd | 227/147 |
| 4,724,616 | 2/1988 | Adleman et al. | 30/360 |
| 4,881,676 | 11/1989 | St. Peter | 227/63 |
| 4,967,623 | 11/1990 | Jackson | 81/44 |
| 5,458,608 | 10/1995 | Wortrich | 227/147 |
| 5,605,271 | 2/1997 | Russell | 227/147 |

*Primary Examiner*—Scott A. Smith
*Attorney, Agent, or Firm*—Peter Loffler

[57] ABSTRACT

A drive ring driver for driving drive rings into a desired surface is comprised of a rod that is slidably passed through a handle member. A shaft member is attached and secured to the second end of the rod via a rod adaptor. A drive ring head is secured to the shaft and is adapted to receive the head portion of a drive ring. Once the drive ring is received within the drive ring head, a force is imparted onto the first end of the rod and is transferred to the drive ring, thereby driving the drive ring into its intended surface.

15 Claims, 3 Drawing Sheets

DRIVE RING DRIVER

BACKGROUND OF THE INVENTION

1. Field of the Invention

The present invention relates to an impact imparting device and more specifically to a device to assist in driving drive rings into proper position.

2. Background of the Prior Art

The laying of cable, such as telephone cable or computer cable requires that the cable be properly secured along its length. This requires securing the cable to a wall, a ceiling or other similar object in order to properly hold the cable in place. One way of accomplishing this securement is to drive a fastening device, such as a staple, into the desired point of securement. The staple straddles the cable and thus does not inflict any damage onto the cable. However, in many situations, such as placement of telephone cable within a structure, a staple is too small to adequately hold the cable. Therefore, a drive ring is used for cable securement. The drive ring is relatively larger than a staple and is able to penetrate deeper into a wall or ceiling and is thus much better at securely holding the cable thereto.

Drive ring installation is much more difficult than that of a staple. Staple guns of many different designs, both automatic and manual, are known in the art. However, devices to assists the installation of drive rings are yet to be proposed. The current method of drive ring installation is for a worker to hold the drive ring with one hand and to impart a force onto the drive ring with a hammer or similar object with the other hand.

Such a method of drive ring installation has obvious drawbacks. By being required to hold the drive ring with one hand while striking the drive ring with the other, the worker exposes himself to potential injury with every strike of the hammer. One wrong strike and the worker can seriously bruise or break his fingers and thumb. Furthermore, such an installation method is very inefficient whenever the drive ring must be driven into a surface that is not readily accessible to the worker such as a ceiling or underneath a floorboard. Such installation requires the worker to either ascend a chair or ladder in the case of a ceiling, or to lie on the ground or to strike the drive ring blind in the case of a floorboard. Either scenario is time inefficient and has the potential to cause injury to the worker performing the installation.

Therefore, there is a need in the art for a device that assists a worker in securing a drive ring to a fixture such as a wall, ceiling, or floorboard. The device must be efficient to use without exposing the worker to undue potential injury. Ideally, the device will have similar installation efficiency whether used to install a drive ring above a worker's reach or below his line of sight. The device should be of relatively simple design and construction and should be easy to use and maintain.

SUMMARY OF THE INVENTION

The drive ring driver of the present invention addresses the aforementioned needs in the art. The drive ring driver provides for a device that positions a drive ring proximate its intended imbediment surface and permits driving the drive ring into position. The drive ring driver minimizes the potential of the driving force directly contacting a worker, thereby greatly reducing injury potential.

The drive ring driver of the present invention is comprised of a rod having a first end and a second end. The rod is passed through an open channel of a handle member and the first end is capped. The handle member may slide along the length of the rod. A rod adapter is secured to the second end of the rod. A shaft member is attached to the rod adapter and secured thereto. A drive ring head is attached to the opposing end of the shaft member and is secured thereto. The head portion of a drive ring is received within the top of the second end of the drive ring head. A force is occasioned onto the first end of the rod and is mechanically transferred to the drive ring and the drive ring is driven into its intended surface. A shaft adapter can be used to interconnect two or more shafts in order to increase the overall length of the device.

The drive ring driver of the present invention can be used to install a drive ring into a surface above the reach of the worker, such as a ceiling, and can also be used to install the drive ring into a surface that is below the line of sight of the worker, such as the underside of a floorboard. In either case, injury potential is minimal. The drive ring driver is of relatively simple and straightforward design and construction and is relatively easy to use and maintain. The drive ring driver is relatively easy to disassemble and is easy to transport.

BRIEF DESCRIPTION OF THE DRAWINGS

Similar reference numerals refer to similar parts throughout the several views of the drawings.

DESCRIPTION OF THE PREFERRED EMBODIMENT

Figure 1:
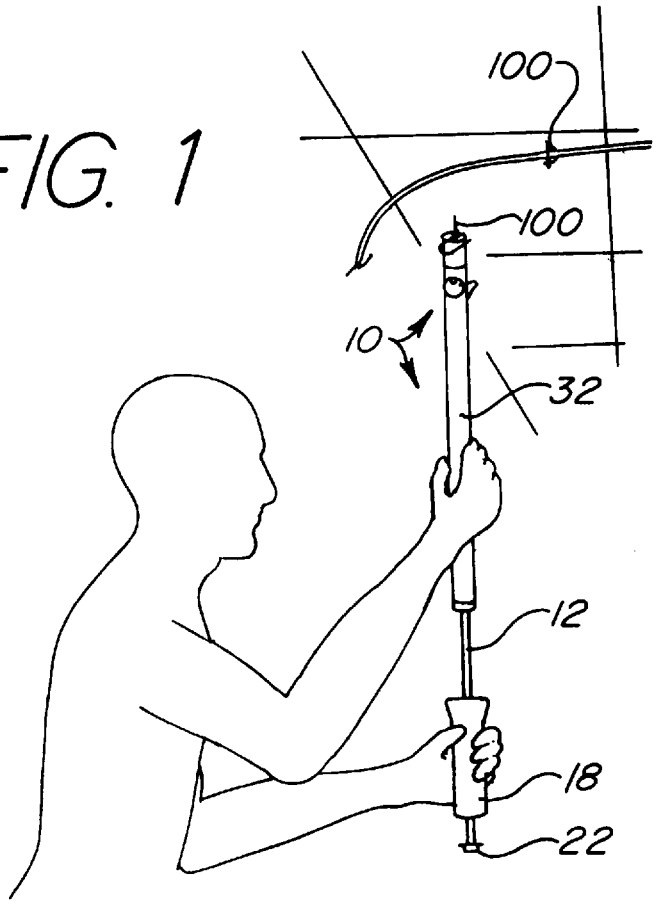
FIG. 1 is a perspective view of the drive ring driver being used to install drive rings into a ceiling.

Referring now to the drawings, it is seen that the drive ring driver of the present invention, generally denoted by reference numeral 10, is comprised of a rod 12 having a first end 14 and a second threaded end 16. A handle member 18 has an open channel 20 running through its central axis. The rod 12 passes through the open channel 20 and has a nut 22 (or other similar strike surface) secured (threadably, fixedly, or otherwise) to the first end 14. A rod adapter 24 has a first end 26 and a second end 28 such that the cross-section of the first end 26 is relatively larger than the cross-section of the second end 28. An open channel 30 passes laterally through the rod adapter 24 proximate its second end 28. An opening (not illustrated) having female threading is located within the first end 26 of the rod adapter 24. The second end 16 of the rod 12 is threadably received within the first end 26 of the rod adapter 24. It is expressly recognized that other securement means can be utilized to secure the rod 12 to the rod adapter 24.

A shaft member 32 is a relatively thin elongate member having a open first end 34 and an open second end 36. A first pair of aligned apertures 38 is located within the first end 34 while a second pair of aligned apertures 40 is located within the second end 36. The first end 34 of the shaft member 32 is adapted to receive the second end 28 of the rod adapter 24. Once the rod adapter 24 is received within the first end 34 of the shaft member 32, the first pair of apertures 38 are aligned with the open channel 30 of the rod adapter 24. A securement member, such as the illustrated shank 42 or a cotter pin (not illustrated) or other similar device is passed through the aligned first pair of apertures 38 and channel 30.

Figure 2:
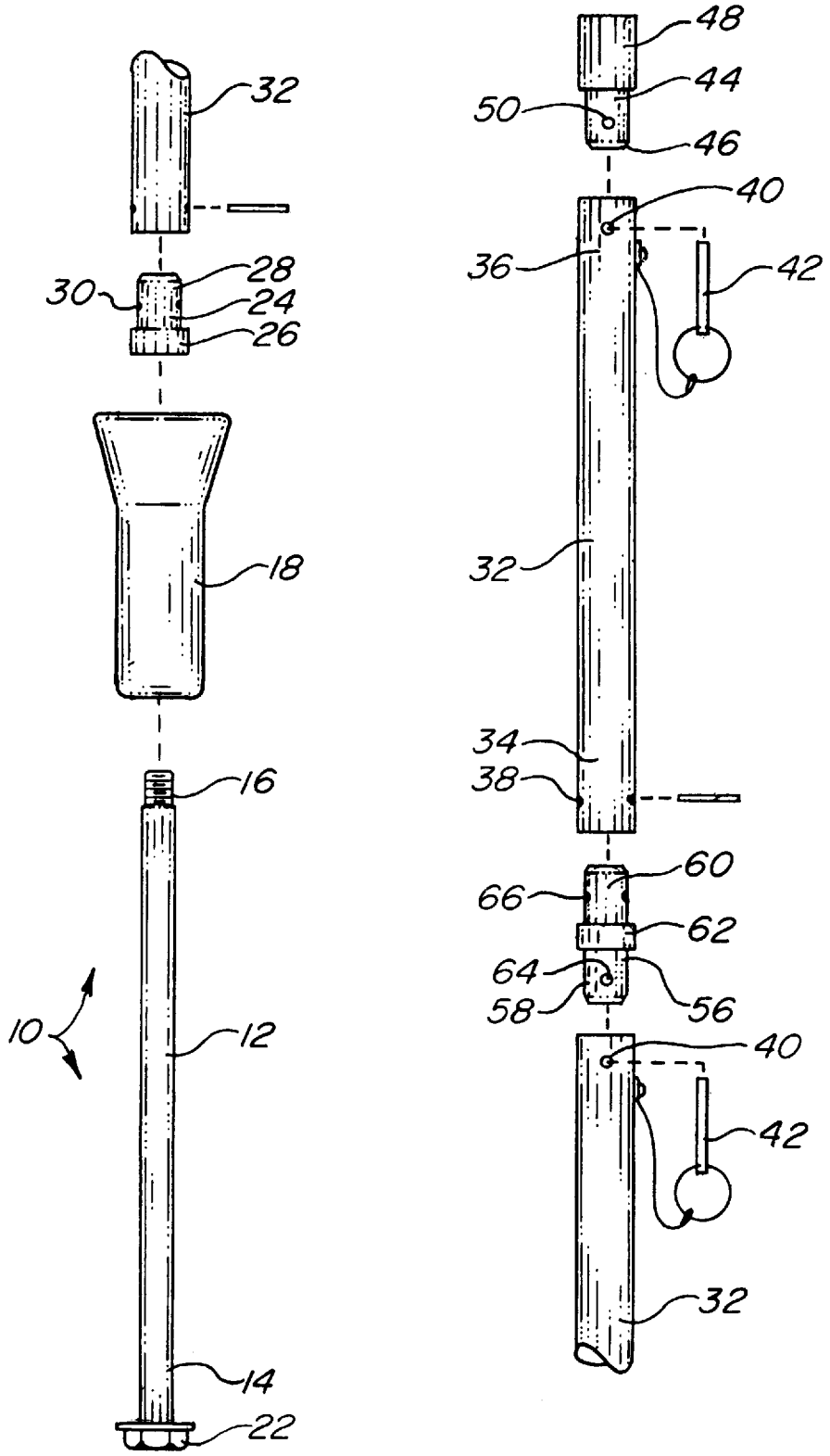
FIG. 2 is an exploded side elevation view of the drive ring driver having two stages.
Figure 3:
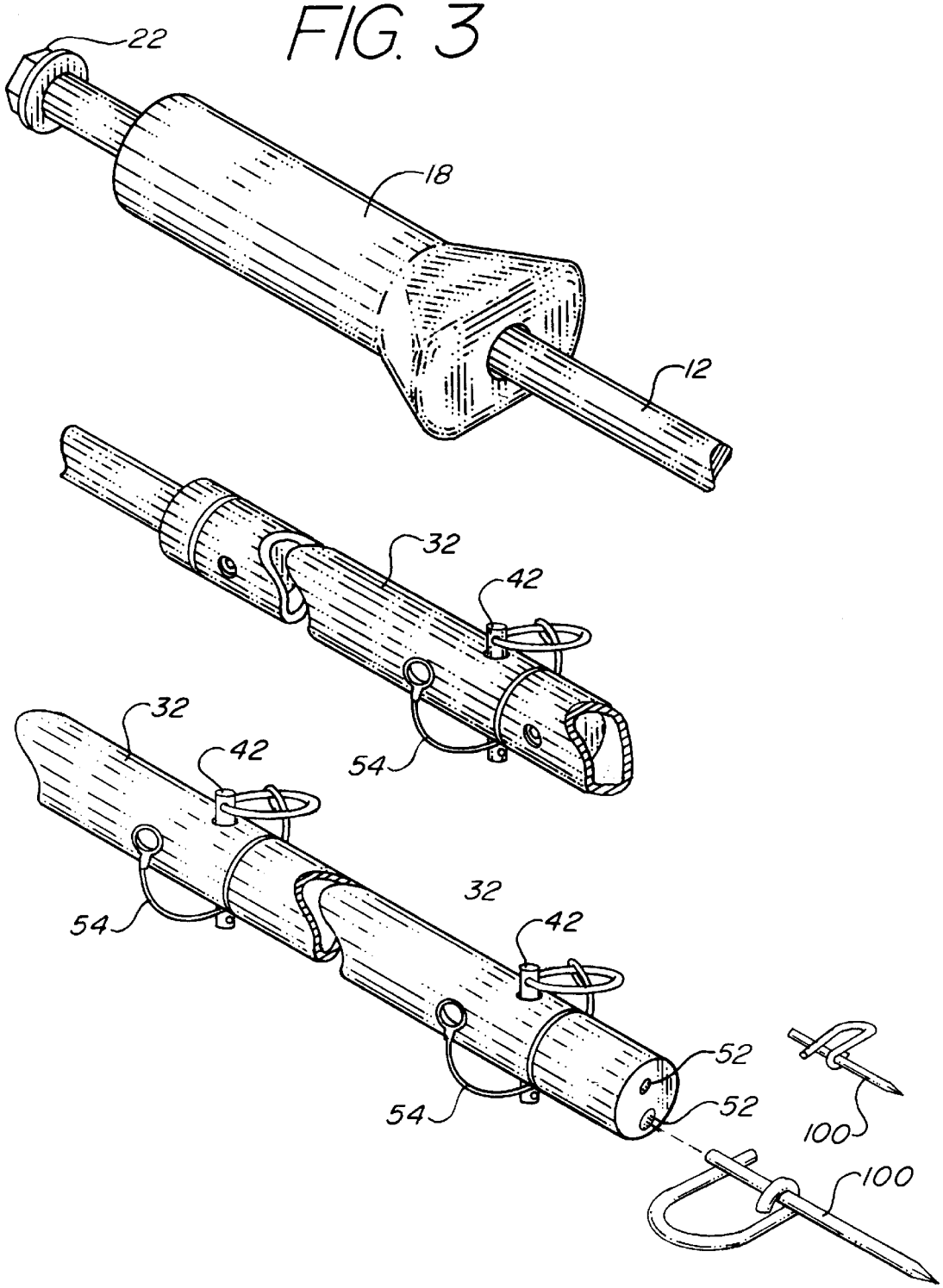
FIG. 3 is a broken perspective view of the drive ring driver having two stages.

A drive ring head 44 has a first end 46 and a second end 48 such that the cross-section of the first end 46 is relatively smaller than the cross-section of the second end 48. An open channel 50 passes through the first end 46 of the drive ring head 44. As seen in FIG. 3, the top of the second end 48 of the drive ring head 44 has at least one opening 52 thereon. The opening 52 is adapted to receive the head portion of a drive ring 100. The use of more than one opening 52 will allow the device 10 to be used with drive rings 100 of more than one size. The first end 46 of the drive ring head 44 is received within the second end 36 of the shaft member 32. The second pair of apertures 40 of the shaft member 32 is aligned with the open channel 50 of the drive ring head 44 and a securement member, such as the as the illustrated shank 42 or a cotter pin (not illustrated) or other similar device is passed through the aligned second pair of apertures 40 and channel 50. As seen in FIG. 2, the securement member may have a tethering element 54 to attach the securement member to the shaft member 32 (the securement member used to secure the rod adapter 24 to the shaft member 32 may also be tethered to the shaft member 32).

In order to use the drive ring driver 10 of the present invention, the rod 12 is passed through the open channel 20 of the handle member 18 and, if needed, the nut 22 is secured to the first end 14. The rod adapter 24 is secured to the second end 16 of the rod 12. The second end 28 of the rod adapter 24 is received within the first end 34 of the shaft member 32. The first pair of apertures 38 of the shaft member 32 is aligned with the open channel 30 of the rod adapter 24 and the securement member is passed therethrough. The first end 46 of the drive ring head 44 is received within the second end 36 of the shaft member 32. The second pair of apertures 40 of the shaft member 32 is aligned with the open channel 50 of the drive ring head 44 and the securement member is passed therethrough. The device 10 is now assembled. A drive ring 100 is received within one of the openings 52 of the drive ring head 44 and is positioned as desired. An impact force is asserted onto the first end 14 of the rod 12 and this force is mechanically transferred to the drive ring 100 driving it into its intended surface.

The above assembly process is reversed in order to disassemble the drive ring driver 10.

If the length of the drive ring driver 10 needs to be extended, at least one additional shaft member 32 is provided. A shaft adapter 56 is used to connected the two adjoining shaft members 32. As seen, the shaft adapter 56 has a first end 58 and a second end 60 and a medial portion 62 therebetween. The cross-section of the first end 58 and the cross-section of the second end 60 are each smaller than the cross-section of the medial portion 62. A first open channel 64 passes through the first end 58 while a second open channel 66 passes through the second end 60. The first end 58 of the shaft adapter 56 is received within the second end 36 of a shaft member 32. The first open channel 64 of the channel adapter 56 is aligned with the second pair of apertures 40 of the shaft member 32. A securement member is passed therethrough. The second end 60 of the shaft adapter 56 is received within the first end 34 of the other shaft member 32. The second open channel 66 of the channel adapter 56 is aligned with the first pair of apertures 38 of the shaft member 38. A securement member is passed therethrough. Successive shaft members 32 can be attached to one another in similar fashion in order to achieve the desired length for the drive ring driver 10 of the present invention.

While the invention has been particularly shown and described with reference to an embodiment thereof, it will be appreciated by those skilled in the art that various changes in form and detail may be made without departing from the spirit and scope of the invention.

We claim:

1. A drive ring driver comprising:

a handle having a first open channel passing though a central axis;

a rod, having a first end and a second end, adapted to pass through the first open channel;

a rod adapter having a third end with a first cross-section and adapted to receive the second end of the rod and a fourth end with a second cross-section smaller than the first cross-section;

at least one shaft having a fifth end adapted to receive the fourth end of the rod adapter and a sixth end;

a drive ring head having a seventh end having a third cross-section and adapted to be received within the sixth end of the at least one shaft and an eighth end having a fourth cross-section larger than the third cross-section; and at least one opening located on the eighth end of the drive ring head adapted to receive a drive ring.

2. The drive ring driver as in claim 1 further comprising a securement means for securing the fifth end of the at least one shaft to the fourth end of the rod adapter.

3. The drive ring drive as in claim 2 wherein the securement means comprises:

a second open channel passing through the fourth end of the rod adapter;

a pair of aligned apertures located on the fifth end of the at least one shaft and registerable with the second open channel; and an insertion means for insertion through the aligned pair of apertures and the second open channel.

4. The drive ring driver as in claim 3 wherein the insertion means comprises a shank.

5. The drive ring driver as in claim 3 wherein the insertion means comprises a cotter pin.

6. The drive ring driver as in claim 3 wherein the insertion means is tethered to the at least one shaft.

7. The drive ring driver as in claim 1 further comprising a securement means for securing the sixth end of the at least one shaft to the seventh end of the drive ring head.

8. The drive ring drive as in claim 7 wherein the securement means comprises:

a second open channel passing through the seventh end of the drive ring head;

a pair of aligned apertures located on the sixth end of the at least one shaft and registerable with the second open channel; and an insertion means for insertion through the aligned pair of apertures and the second open channel.

9. The drive ring driver as in claim 8 wherein the insertion means comprises a shank.

10. The drive ring driver as in claim 8 wherein the insertion means comprises a cotter pin.

11. The drive ring driver as in claim 8 wherein the insertion means is tethered to the at least one shaft.

12. The drive ring driver as in claim 1 further comprising a shaft adapter having a ninth end with a fifth cross-section and adapted to receive the fifth end of one of the at least one shaft and a tenth end with a sixth cross-section and adapted to receive the sixth end of another of the at least one shaft and a medial portion with a seventh cross-section larger than the fifth cross-section and the sixth cross-section.

13. The drive ring driver as in claim 12 further comprising a first securement means for securing the fifth end of the one of the at least one shaft to the ninth end of the shaft adapter; and a second securement means for securing the sixth end of the other of the at least one shaft to the tenth end of the shaft adapter.

14. The drive ring driver as in claim 1 further comprising a nut attached to the first end of the rod.

15. The drive ring driver as in claim 14 wherein the nut is threadably attached to the first end.

* * * * *